US009719636B2

(12) United States Patent
Engelhardt

(10) Patent No.: US 9,719,636 B2
(45) Date of Patent: Aug. 1, 2017

(54) LED LIGHTING DEVICE

(71) Applicant: Florida Intellectual Properties LLC, North Palm Beach, FL (US)

(72) Inventor: Gary Engelhardt, San Jose, CA (US)

(73) Assignee: Florida Intellectual Properties LLC, Jupiter, FL (US)

( * ) Notice: Subject to any disclaimer, the term of this patent is extended or adjusted under 35 U.S.C. 154(b) by 253 days.

(21) Appl. No.: 13/961,368

(22) Filed: Aug. 7, 2013

(65) Prior Publication Data

US 2015/0043208 A1 Feb. 12, 2015

(51) Int. Cl.

| | |
|---|---|
| ***F21V 1/00*** | (2006.01) |
| ***F21V 11/00*** | (2015.01) |
| ***F21V 5/00*** | (2015.01) |
| ***F21V 7/00*** | (2006.01) |
| ***F21V 3/04*** | (2006.01) |
| ***F21V 15/01*** | (2006.01) |
| ***F21V 19/00*** | (2006.01) |
| ***F21V 29/70*** | (2015.01) |

(Continued)

(52) U.S. Cl.

CPC ..... *F21K 9/17* (2013.01); *F21V 3/04* (2013.01); *F21V 5/00* (2013.01); *F21V 7/00* (2013.01); *F21V 7/005* (2013.01); *F21V 7/0008* (2013.01); *F21V 15/01* (2013.01); *F21V 19/003* (2013.01); *F21V 29/70* (2015.01); *F21Y 2103/10* (2016.08); *F21Y 2115/10* (2016.08)

(58) Field of Classification Search

CPC . F21V 5/00; F21V 7/00; F21V 7/0008; F21V 7/22; F21V 13/04; F21V 29/504; F21V 29/506; F21V 29/83; F21V 23/00; F21V 23/04

USPC ..... 362/241

See application file for complete search history.

(56) References Cited

U.S. PATENT DOCUMENTS

| | | | | |
|---|---|---|---|---|
| 6,238,073 | B1 * | 5/2001 | Ito | B60Q 1/0052 362/236 |
| 7,758,207 | B1 * | 7/2010 | Zhou | F21S 8/06 362/217.1 |

(Continued)

FOREIGN PATENT DOCUMENTS

| | | |
|---|---|---|
| WO | 2010069062 A1 | 6/2010 |
| WO | 2013025252 A1 | 2/2013 |

OTHER PUBLICATIONS

International Search Report mailed Aug. 26, 2014 for International Patent Application PCT/US14/31817 filed Mar. 6, 2014.

*Primary Examiner* — Peggy Neils
*Assistant Examiner* — William N Harris
(74) *Attorney, Agent, or Firm* — McHale & Slavin, P.A.

(57) ABSTRACT

A light-emitting diode ("LED") based lighting fixture is provided. The LED based lighting fixture includes at least one reflector having a reflective enhancing material to reflect light and at least one frame are attached on a top surface of at least one housing. Further, one or more LED module mounted on a top surface of the at least one frame to emit light, the at least one frame oriented at an angle in a range of 10° to 45° degrees or approximately 30° degrees extending from a plane perpendicular to a plane of the top surface of the at least one housing. Finally, at least one lens such as a frost lens or a translucent lens can be positioned approximate to a bottom surface of the at least one housing for reflective light to emit there through.

27 Claims, 13 Drawing Sheets

(51) Int. Cl.

| | |
|---|---|
| ***F21Y 103/10*** | (2016.01) |
| ***F21Y 115/10*** | (2016.01) |
| ***F21K 99/00*** | (2016.01) |

(56) References Cited

U.S. PATENT DOCUMENTS

| | | | | |
|---|---|---|---|---|
| 7,841,738 | B2 * | 11/2010 | Engel | F21S 8/04 362/235 |
| 8,552,463 | B2 | 10/2013 | Tischler et al. | |
| 9,291,316 | B2 * | 3/2016 | Dixon | F21L 4/00 |
| 2009/0034252 | A1 | 2/2009 | Engel | |
| 2012/0051041 | A1 * | 3/2012 | Edmond | F21S 8/026 362/231 |
| 2012/0327650 | A1 * | 12/2012 | Lay | F21V 13/04 362/231 |
| 2013/0021792 | A1 | 1/2013 | Snell et al. | |
| 2013/0176722 | A1 | 7/2013 | Lay et al. | |

* cited by examiner

SECTION K-K

LED LIGHTING DEVICE

BACKGROUND

1. Field

This patent specification relates generally to LED based lighting fixtures. More particularly, this patent specification relates to devices, assemblies and systems for LED based lighting fixtures.

2. Background

There are many different types of lighting fixtures, including ceiling-mounted fixtures used for various applications and locations that are known within the art. Such fixtures have been installed for illuminating commercial entities, such as stores, offices, supermarkets, schools, hospitals, banks, and other interior areas.

Light emitting diodes (LEDs) represent an option as a potential replacement technology for incandescent and fluorescent lighting systems. For example, LED lighting systems are often more efficient and frequently have a much longer potential life span than the systems they are designed to replace. In particular, to produce a given output of light, an LED consumes less electricity than an incandescent or a fluorescent light and, on average, the LED will last longer before failing.

For example, the level of a typical LED output can depend on an amount of electrical current supplied to the LED and on an operating temperature of the LED. Specifically, the intensity of light emitted by an LED changes according to electrical current and LED temperature, such that the operating temperature also impacts the usable lifetime of most LEDs.

LEDs generate heat by converting electricity into light, wherein the heat raises the operating temperature (if allowed to accumulate), resulting in efficiency degradation and premature failure. Known conventional technologies for handling and removing this heat are generally limited in terms of performance and integration. For example, most heat management systems are separated from the optical systems that handle the light output by the LEDs. The lack of integration often fails to provide a desirable level of compactness or to support efficient luminaire manufacturing.

Therefore, there is a need for an integrated system that can manage heat and light in an LED-based luminaire. Further, there is a need for an integrated system that provides thermal management, mechanical support, and optical control. An additional need exists for a compact lighting system having a design supporting low-cost manufacture.

SUMMARY

According to an embodiment, a light-emitting diode ("LED") based lighting fixture (or LED lighting device) is provided. The LED based lighting fixture includes at least one reflector having a reflective enhancing material to reflect light and at least one frame attached on a top surface of at least one housing. Further, one or more LED modules are mounted on a top surface of the at least one frame to emit light; the at least one frame oriented at an angle in a range of 10° to 45° or approximately 30° extending from a plane perpendicular to a plane of the top surface of the at least one housing. Finally, at least one lens, such as a frost lens or a translucent lens, can be positioned approximate to a bottom surface of the at least one housing for reflective light to emit there through.

According to some aspects of the claimed subject matter, the at least one housing includes at least one lens frame having at least one aperture that can be attached to the bottom surface of the housing so as to secure the at least one lens. Further, the lighting fixture can be substantially made of an aluminum material, and acts as a heat sink to dissipate heat generated by the one or more LED module. Further still, the light fixture can be a troffer that provides a light distribution of one of a horizontal light output, vertical light output or some combination thereof. It is possible that at least one LED module of the one or more LED modules can be dimmable and includes at least one white LED light. Further still, the at least one reflector can include two or more end plates.

According to another aspect of the claimed subject matter, the reflective enhancing material can be one of a white optics material or a material having properties similar to reflective properties of the white optics material. Further, the lighting fixture can include at least one junction box, such that the junction box can be vented via natural convection by one or more vents.

According to another aspect of the claimed subject matter, the troffer can provide for a lumen output range from one of 2,900 lumens to 6,000 lumens or more, 6,000 lumens to 12,000 lumens or more, or 12,000 lumens to 32,000 lumens or more. Further, the at least one housing can include two or more apertures, and the at least one lens frame may include two or more apertures, such that the two or more apertures of the at least one housing and the at least one lens frame are approximately aligned, so together dissipate heat generated by the one or more LED modules.

According to some embodiments, the light-emitting diode ("LED") based lighting fixture which comprises at least one reflector can include a reflective enhancing material such as a white optics material to reflect light and two or more frames, wherein the at least one reflector and two or more frames can be attached on a top surface of at least one housing. Further, two or more LED modules can be mounted on a top surface of the two or more frames to emit light; the two or more frames can be oriented at an angle in a range of 10° to 45°, or approximately 30°, extending from a plane perpendicular to a plane of the top surface of the at least one housing, so as to form a V-shape type of orientation. Finally, at least one lens, such as a frost lens or a translucent lens, can be positioned approximate to a bottom surface of the at least one housing for reflective light to emit there through, so as to provide a uniform lighting effect.

According to another aspect of the claimed subject matter, the lighting fixture can be a troffer substantially made of an aluminum material, which acts as a heat sink to dissipate heat generated by the one or more LED modules. Further, the light fixture can be a troffer that at least provides a horizontal light output distribution, such that at least one LED module of the one or more LED modules can be dimmable and includes at least one white LED light. Further still, the troffer can provide for a lumen output range from 2,900 lumens to 32,000 lumens or more, and a solder point temperature equal to or less than 33° Celsius, equal to or less than 40° Celsius, or equal to or less than 55° Celsius.

According to another aspect of the claimed subject matter, the at least one housing can include two or more apertures, and the at least one lens frame includes or may include two or more apertures, such that the two or more apertures of the at least one housing and the at least one lens frame are approximately aligned, and therefore together dissipate heat generated by the one or more LED modules. Further, the two or more apertures of the at least one housings, the at least one lens frame, or both can occupy at least 10% of a total surface area of the top surface area of the housing. It is possible that the lighting fixture includes a universal mounting device, and the universal mounting device includes two or more brackets attached to the housing, so that an attaching material, such as a wire, is provided for securing the lighting fixture for operation. Further still, the lighting fixture can include at least one junction box, such that the junction box can be vented via natural convection by one or more vents. Further, one or more surfaces of the at least one reflector can include one of a dome shape or an arc shape, such that an end portion of a first side has a 90° angle and an end portion of a second side has a 90° angle.

According to another aspect of the claimed subject matter, the lighting fixture can include at least one aluminum circuit board that can be attached to the at least one housing by an attaching device made at least partially of an aluminum material. Further, the aluminum circuit board can include electronic chips or integrated circuits positioned on the at least one aluminum circuit board in strings of four or more so as to maintain a drive current. Further still, the lighting fixture can include a drive current of approximately 58.2 mA or less, approximately 80 mA or less, or approximately 100 mA or less. It is possible that the at least one reflector can be integral with the at least one frame and fastened to the at least one housing. Further, the at least one frame can be approximately equal to or greater than 5% or more, or 10% or more of a total surface area of the top surface of the at least one housing. Further still, the at least one frame can extend more than 30% or more, 50% or more, 70% or more, or 80% or more along a side of the at least one housing. Further, the reflective enhancing material can be textured, such that the texture is from the group consisting of a uniform imprinted texture, a non-uniform imprinted texture, an imprinted geometric shape or some combination thereof.

According to another aspect of the claimed subject matter, the one or more LED modules can be positioned so that at least 80% or more, or 85% or more, of the light is incident on the reflective enhancing material of the at least one reflector. Further, the at least one reflector can include one of a uniformed imprinted textured surface, a non-uniform imprinted textured surface, or some combination thereof, so as to reflect light, wherein the textured reflector comprises of a material that is at least semi specular before the reflector is textured.

According to some embodiments, a light-emitting diode ("LED") based lighting system includes at least one reflector having a reflective enhancing material such as a white optics material to reflect light, and two or more frames; the at least one reflector and the two or more frames can be attached on a top surface of at least one housing. Further, two or more LED modules can be mounted on a top surface of the two or more frames to emit light, the two or more frames oriented at an angle in a range of 10° to 45°, or approximately 30°, extending from a plane perpendicular to a plane of the top surface of the at least one housing, so as to form a V-shape type of orientation. Finally, at least one lens, such as a frost lens or a translucent lens, can be positioned approximate to a bottom surface of the at least one housing for reflective light to emit there through, so as to provide a uniform lighting effect.

According to another aspect of the claimed subject matter, the lighting fixture can be a troffer substantially made of an aluminum material, which acts as a heat sink to dissipate heat generated by the one or more LED modules. A further aspect may be that the light fixture provides a horizontal light output distribution, such that at least one LED module of the one or more LED modules can be dimmable, and includes at least one white LED light. Further still, the troffer may provide for a lumen output range from 2,900 lumens to 32,000 lumens or more, a solder point temperature of equal to or less than 33° Celsius or both. Further still, the lighting fixture can include at least one junction box, such that the junction box can be vented via natural convection by one or more vents. It is possible the lighting fixture can include at least one aluminum circuit board that is attached to the at least one housing by an attaching device made at least partially of an aluminum material.

Further features and advantages will become more readily apparent from the following detailed description when taken in conjunction with the accompanying drawings.

BRIEF DESCRIPTION OF THE DRAWINGS

The present disclosure is further described in the detailed description which follows, in reference to the noted plurality of drawings by way of non-limiting examples of exemplary embodiments, in which like reference numerals represent similar parts throughout the several views of the drawings, and wherein.

DETAILED DESCRIPTION OF THE EMBODIMENTS

Figure 1A:
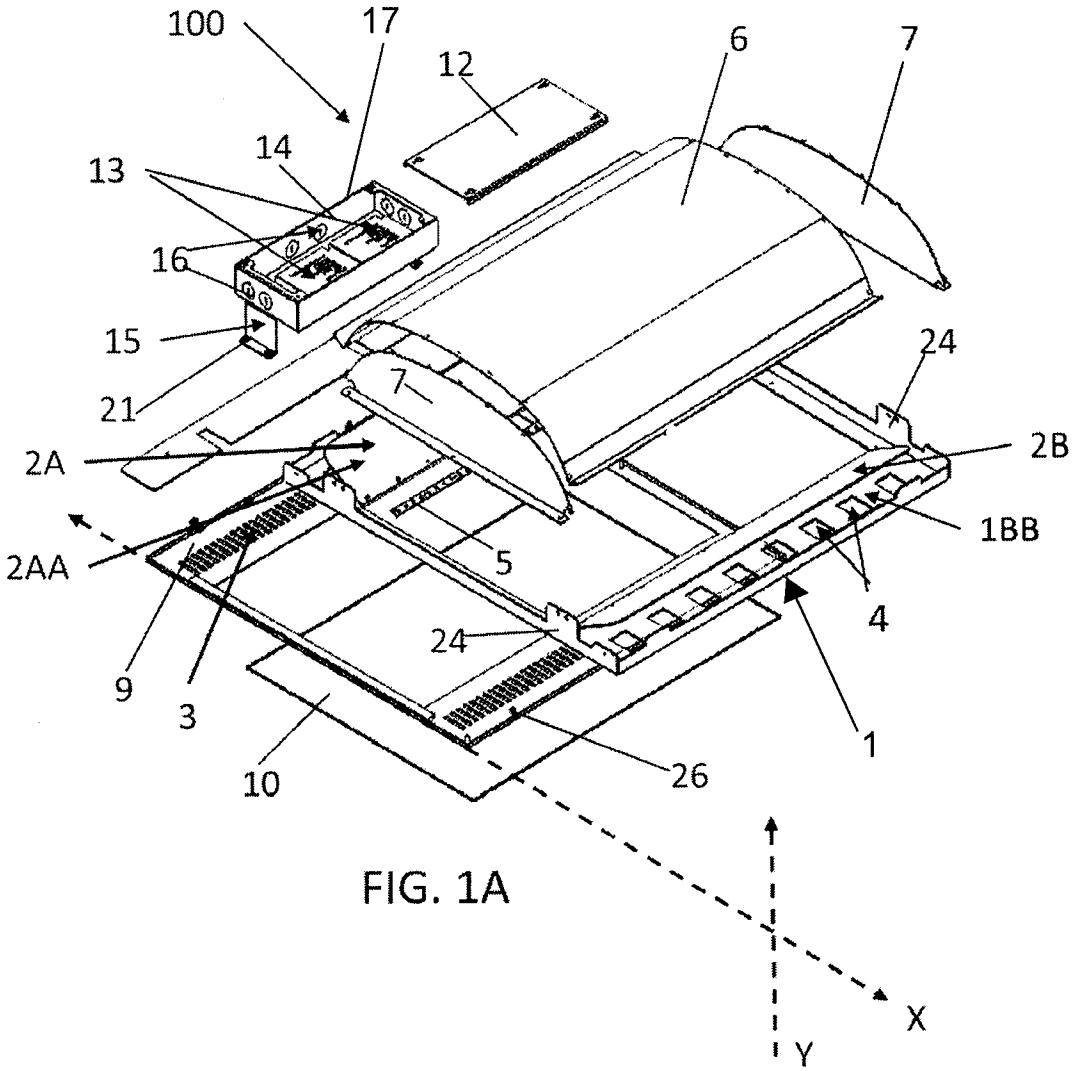
FIG. 1A is an exploded view of an LED based light fixture in accordance with an exemplary embodiment of the disclosed subject matter.

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, processes, and other elements in the invention may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicate like elements.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not discussed or included in a figure. Furthermore, not all operations in any particularly described process may occur in all embodiments. A process may correspond to a method, a function, a procedure, a subroutine, a subprogram, etc. When a process corresponds to a function, its termination corresponds to a return of the function to the calling function or the main function.

Some embodiments of the presently disclosed subject matter generally relate to devices, systems and methods for a light-emitting diode ("LED") based lighting fixture. In particular, embodiments of the present invention can provide a modular troffer-style fixture that is particularly well-suited for use with solid state light sources, such as LEDs. To facilitate the dissipation of unwanted thermal energy away from the light sources, the light fixture is substantially made of aluminum material, wherein it acts as a heat sink to dissipate heat generated by one or more LED modules positioned on the one or more frames attached to the housing. Further, the one or more LED modules can be mounted on a top surface of the at least one frame to emit light; the at least one frame can be oriented at an angle in a range of 10° to 45°, or approximately 30°, extending from a plane perpendicular to a plane of the top surface of the at least one housing. End caps are arranged at both ends of the reflector. The LED based light fixture 100 is well suited for a fixture application for solid state light emitter devices. The LED based lighting fixture can be shaped as a troffer. By non-limiting example, a 24 inch by 48 inch troffer or 24 inch by 24 inch troffer; however, all different shapes and sizes of troffers are contemplated. Further, the LED based lighting fixture is not limited to only troffers, but can be for other devices either within the light fixture marketplace or outside of the light fixture marketplace.

At least one embodiment of the LED based lighting fixture includes a reflector having a reflective enhancing material to reflect light and at least one frame attached on a top surface of at least one housing. Further, one or more LED modules mounted on a top surface of the at least one frame emits light; the at least one frame can be oriented at an angle in a range of 10° to 45°, or approximately 30°, extending from a plane perpendicular to a plane of the top surface of the at least one housing. Finally, at least one lens, such as a frost lens or a translucent lens, can be positioned approximate to a bottom surface of the at least one housing for reflective light to emit there through.

FIG. 1A is an exploded view of an LED based light fixture in accordance with an exemplary embodiment of the disclosed subject matter. The LED based light fixture 100 includes a reflector 6 having end plates 7 located at both ends of the reflector 6. The reflector 6 may be connected in series wherein a single end plate 7 may be utilized as an end plate for two reflectors (see character reference number 28 of FIG. 11). The reflector 6 and end plates 7 are fastened together by one of spot welding, rivets, and tab portions extending from the reflector 6, the two end plates 7 or both; a fastener made of an alloy material such as aluminum or other materials having similar properties. The reflector 6 and end plates 7 are fastened to a housing 1 by fasteners, spot welding or by other attaching methods. It is noted that the housing could also be called heat sink housing. The reflector is fastened at both ends to the top of the heat sink housing from the bottom side. There is a double sided tape that can be used at both ends of the reflector. The reflector housing can require a double sided tape at both ends where the reflector meets the heat sink housing. It can require six 8/32 tech screws.

Still referring to FIG. 1A, the housing 1 includes frames 2 (2A, 2B), wherein one or more LED module(s) 5 is/are mounted on a top surface 2AA of the at least one frame 2 to emit light, the at least one frame 2 is oriented at an angle in a range of 10° to 45°, or approximately 30°, extending from a plane Y perpendicular to a plane X of the top surface 1BB of the housing 1. The illuminations from the LEDs 5 are reflected upwards from the frame 2 toward the reflector 6, so the light is reflected downward from the reflector 6 and through the lens 10. The housing 1 includes apertures 4 that can be utilized to dissipate heat generated by the one or more LED modules 5 positioned on the top surface 2AA of the at least one frame 2. However, the apertures 4 are not required to be utilized to dissipate heat generated by the one or more LED modules 5. In fact, the apertures 4 can be eliminated from the housing 1. The lighting fixture 100 is contemplated to be substantially made of an aluminum material, such that substantial portions of the lighting fixture 100 act as a heat sink to dissipate heat generated by the one or more LED modules 5. Thus, it is not required for the housing 1 to have apertures 4. At least one advantage, among others, is that the fixture offers better thermal management, and can be easy to install because of the 6 lbs. (which is approximately the overall weight for the 2×2 and 12 lbs. for the 2×4 fixtures). It is possible that the at least one reflector 6 is integral with the at least one frame 2 of the housing 1, and that the reflector 6 with the frame 2 is fastened to the at least one housing 1. It is contemplated that the frame 2 is made of an aluminum material, and at least one frame 2 is approximately equal to or greater than one of 5% or more, 10% or more of a total surface area of the top surface 1BB of the at least one housing 1. Further, at least one frame 9 can extend more than one of 30% or more, 50% or more, 70% or more, or 80% or more along a side of the at least one housing 1.

The housing 1 includes a plurality of mounting brackets 24 for securing the lighting fixture 100 for operation. The mounting brackets 24 are positioned on both ends of the housing 1; however, other locations on the housing and lighting fixture are contemplated. It is contemplated that the mounting brackets 24 comprise of a universal mounting device, wherein the universal mounting device includes two or more brackets 24 attached to the housing 1 (or other possible locations on the lighting fixture), so that an attaching material, such as a wire (not shown), is provided for securing the lighting fixture 100 for operation. Further, it is possible for the fixture to be pendant, wire or chain hung, as well as installed in any grid ceiling.

Still referring to FIG. 1A, a junction box 14 is attached to the lighting fixture 100 via a mounting bracket 15 with one or more fasteners 21. The junction box 14 includes a cover 12, wherein the junction box 14 may also include one or more vents 16 for providing natural convention to dissipate heat generated from the at least one LED driver 13. It is contemplated that the cover 12 and bottom 17 of the junction box may include one or more vents 16 which will offer major improvements in driver case temperature and lifetime. It is contemplated that the junction box 14 includes at least one aluminum circuit board, wherein the junction box 14 is substantially made of an aluminum material. Wherein the aluminum circuit board can be attached to the aluminum heat sink (frame 2) with one bolt (or some other fastening means) for every inch or by using a thermal glue. Another aspect of the disclosed subject matter includes the chips located in the junction box to be laid on the circuit boards in strings of four, this allows the lighting fixture to operate at 24 volts with no variations (wherein the drive current is at approximately 58.2 mA). At least one advantage of keeping the drive current as low as possible is that it keeps the solder temperature at approximately 33° and increases the lifetime and performance to levels believed to be impossible within the Solid State Lighting industry.

Still referring to FIG. 1A, a lens frame 9 is fastened to a bottom of the housing 1, wherein the lens frame 9 includes a plurality of apertures 3. It is contemplated that the at least one housing 1 includes two or more apertures 4, and the at least one lens frame 9 includes two or more apertures 3, such that the two or more apertures 3, 4 of the at least one housing 1 and the at least one lens frame 9 are approximately aligned, so together dissipate heat generated by the one or more LED modules 5. The lens frame 9 includes fasteners so as to be attached to the housing 1. The attaching means may be from the group consisting of one of fasteners, such as bolts, rivets, pegs, etc., spot welding and the like.

Still referring to FIG. 1, the apertures 3, 4 of the housing 1 and lens frame 9 may include different shapes, such as one of a uniform shape, non-uniform shape, geometric shape or some combination thereof. Aperture shapes contemplated include square, circle, rectangular, oval, slot, etc., such that the shapes may be all the same shape or different shapes. Further, it is contemplated the apertures 3, 4 may be one of a uniform pattern, a non-uniform pattern, a linear pattern, a non-linear pattern or some combination thereof on the housing 1 and/or lens frame 9. It is possible the two or more apertures 3, 4 of one of the at least one housing 1, the at least one lens frame 9, or both occupy at least 10% of a total surface area of the top surface area 1BB of the housing 1. It is noted that a circumference for each aperture 4 of the housing 1 can be greater than a circumference for each aperture 3 of the lens frame 9. Further, it is contemplated that the housing apertures 4 total venting area may have a total surface area of the top surface area 1BB of the housing that is greater than the total venting area of a total surface area of the top surface area of the lens frame.

Still referring to FIG. 1, a lens 10 is fastened to the lens frame 9. The lens 10 may be a frost lens or a translucent lens for reflective light from the reflector 6 to emit there through.

Figure 1B:
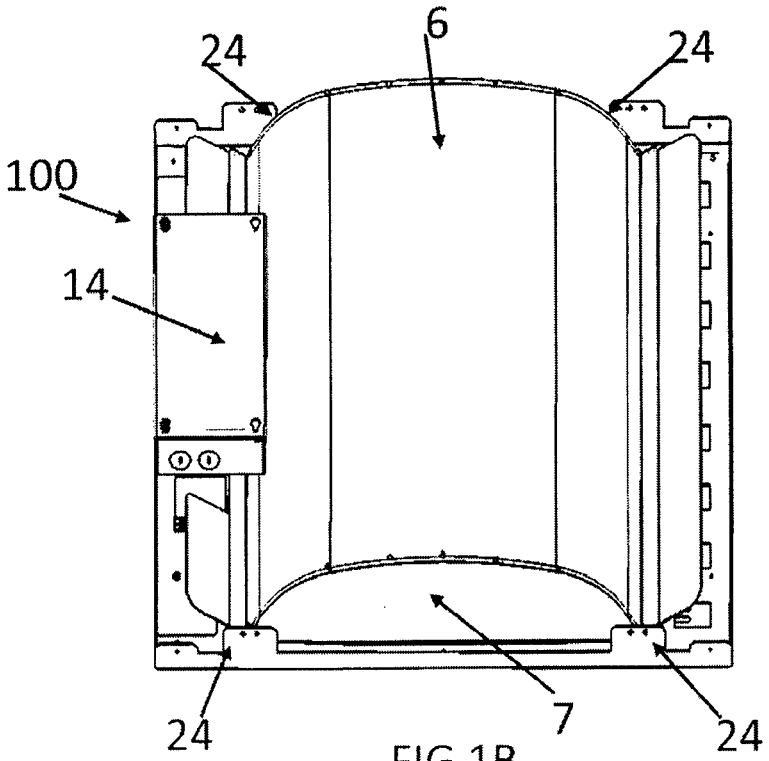
FIG. 1B illustrates a top view of the housing of the LED based light fixture of FIG. 1A in accordance with the disclosed subject matter.

FIG. 1B illustrates a top view of the housing 1 of the LED based light fixture 100 of FIG. 1A. The junction box 14 appears mounted on the lighting fixture 100. Also, the mounting brackets 24 for securing the lighting fixture 100 for operation are shown. Further, the reflector 6 and end plate 7 are also shown.

Figure 1C:
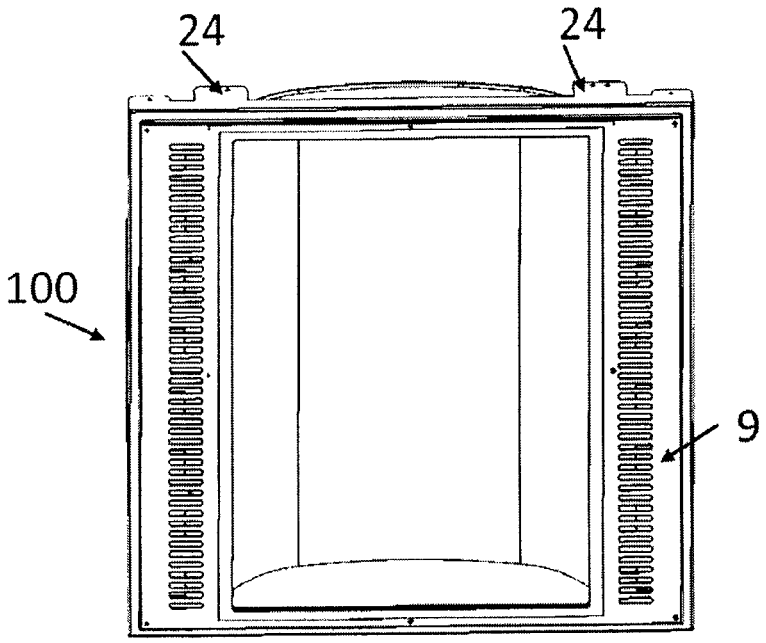
FIG. 1C illustrates a bottom view of the LED based light fixture of FIG. 1A in accordance with the disclosed subject matter.

FIG. 1C illustrates a bottom view of the LED based light fixture of FIG. 1A. The mounting brackets 24 for securing the lighting fixture 100 for operation are shown. Further, the lens frame 9 is also shown.

Figure 2A:
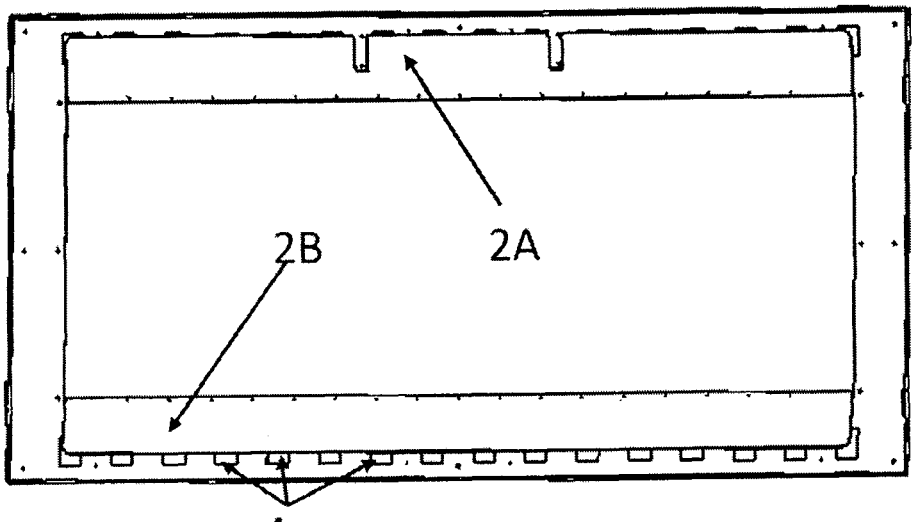
FIG. 2A illustrates a top view of the housing with no LED modules located on either the first side frame or the second side frame of FIG. 1A in accordance with the disclosed subject matter.
Figure 2B:
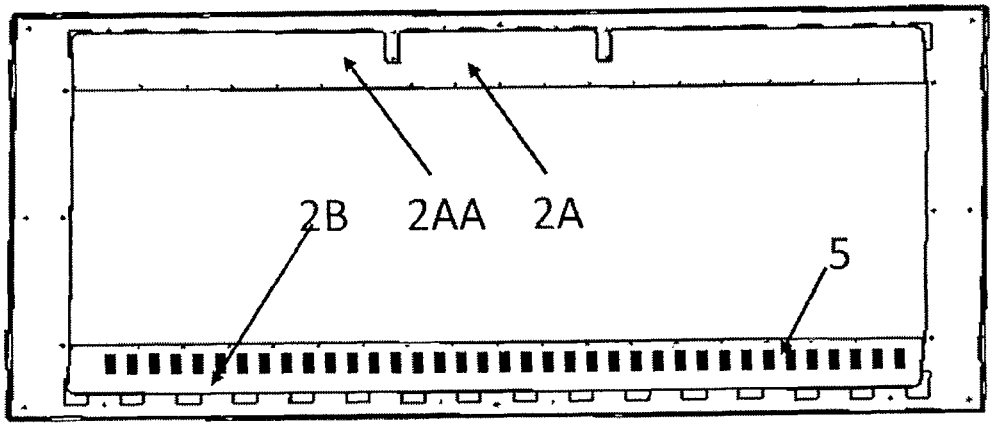
FIG. 2B illustrates a top view of the housing with LED modules located on both the first side frame and the second side frame of FIG. 1A in accordance with the disclosed subject matter.

FIG. 2A illustrates a top view of the housing with no LED modules located on either a first side frame 2A or a second side frame 2B of FIG. 1A. The housing apertures 4 are also shown. It is also noted that the frame 2 extends over at least a portion of the apertures 4 of the housing 1. Further, the apertures 4 extend substantially along the side of the housing 1.

Still referring to FIG. 2A, at least one key concept in view of the disclosed subject matter pertains to thermal management, and that is having the LED lighting device operate efficiently and for a long time. For example, the lower operating temperature of the circuit boards, chips and drivers, will provide for higher performance, reliability and lifetime of the LED based lighting fixture. Thermal management, when done correctly, is both mechanical and electrical. The disclosed subject matter regarding the LED based lighting fixture utilizes several engineered solutions to perfect the art of heat dissipation so as to provide a device that will operate at a low temperature, thus resulting in higher performance, reliability and lifetime. At least one unique feature, among others, is that the frame 2 is stamped so as to create a stamped heat sink, i.e., a stamped heat sync device or frame 2. This is part of a one piece design incorporating large fins outside of the reflector, allowing for natural convention. Also noted is that the aluminum circuit board can be attached to the aluminum heat sink (frame 2) with one bolt (or some other fastening means) for every inch or by using the thermal glue. At least one unique aspect of the disclosed subject matter, among others, is that the entire housing becomes a large heat sink, as well as the other elements of the lighting fixture.

Figure 2C:
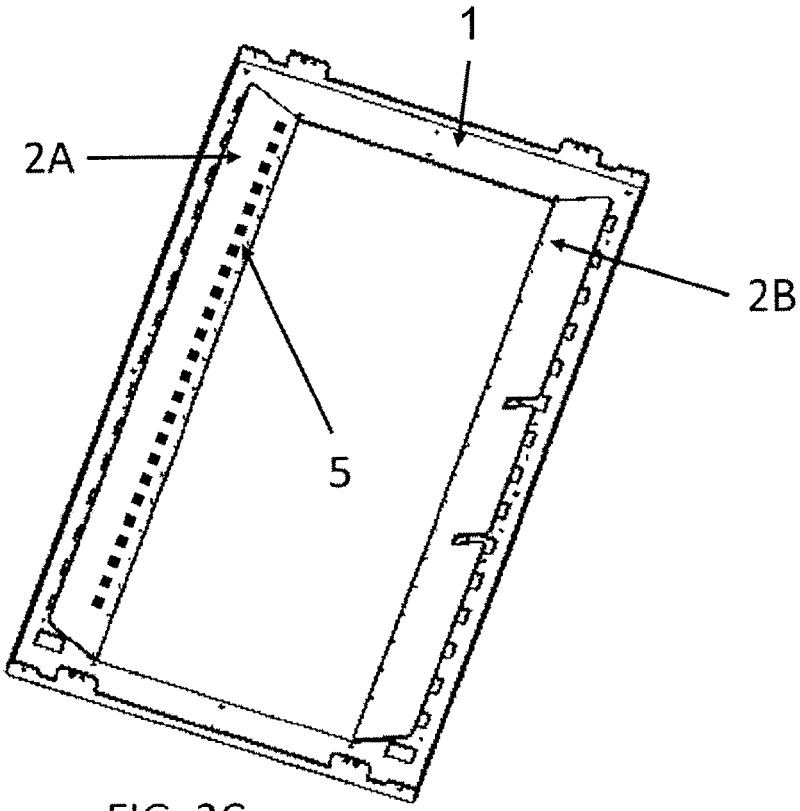
FIG. 2C is a perspective view of the housing with LED modules located on only the first side frame and no LED modules on the second side frame of FIG. 1A in accordance with the disclosed subject matter.
Figure 2D:
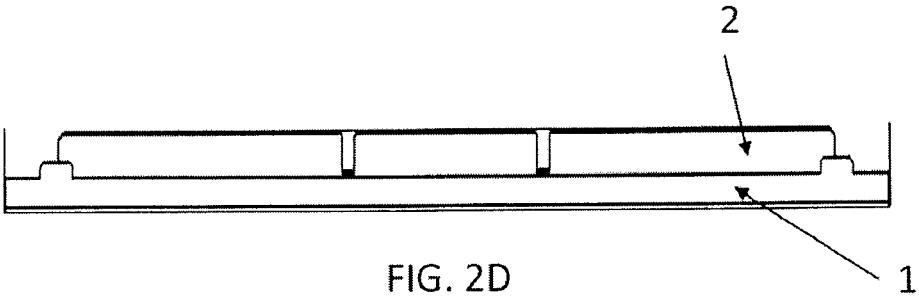
FIG. 2D illustrates a side view of the first side frame of the housing of FIG. 1A in accordance with the disclosed subject matter.
Figure 2E:
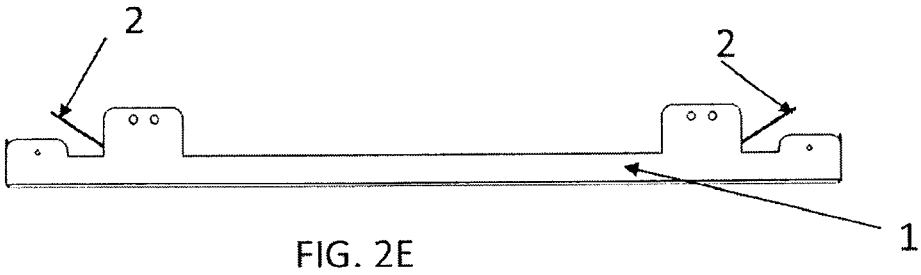
FIG. 2E illustrates an end view of the housing of FIG. 1A in accordance with the disclosed subject matter.

Regarding FIGS. 2B-2E, FIG. 2B illustrates a top view of the housing 1 with LED modules 5 located on both the first side frame 2A and second side frame 2B of FIG. 1A. There can be one or more LED modules 5 located on the top surface 2AA of the frame 2, wherein the first frame 2A may have more LED modules 5 than the second frame 2B, or the other way around. FIG. 2C is a perspective view of the housing 1 with LED modules 5 located on only the first side frame 2A and no LED modules on the second side frame 2B of FIG. 1A. FIG. 2D illustrates a side view of the frame 2 of the housing 1 of FIG. 1A, that shows the frame 2 orientation on the housing 1. FIG. 2E illustrates an end view of the housing 1 of FIG. 1A, showing the two or more frames oriented at an angle in a range of 10° to 45°, or approximately 30°, extending from a plane perpendicular to a plane of the top surface of the at least one housing (see FIG. 1A), so as to form a V-shape type orientation.

Still referring to FIGS. 2B-2E, FIG. 2B illustrates that at least one configuration of an LED strip may include the LED circuit boards being laid out in strings of four on an LED strip, so as to have 9 strings and 36 chips per LED strip; wherein two LED strips comprise 72 chips and 18 strings for a basic model. A High Performance version may include doubling everything, but always in strings of four. Each chip is six (6) volts or twenty-four (24) volts for a string of four. Specifically, this is at least one reason why the driver output needs to be close to approximately twenty-four volts. For example, if the drive current is 1050 milliamps with 18 strings (that's 1050 divided by 18=58.34 mA); when it is doubled, the LEDs have 36 strings of four such that the drive current becomes approximately 29 mA. Accordingly, this drive current is too low. At least one way to get back to approximately 58 mA is to provide a 2100 mA driver. The result or difference is that the performance is still in our range, but the lumens have just doubled. Further, if the drive current is increased by running at more than approximately 58 mA, then the lumens go up and the efficiency goes down. The other problem that develops is thermal management, such that, as the temperature goes up on all the components, the harder it is to drive it. It is believed that the lighting industry drives the drive current at 150 mA so as to achieve the maximum amount of lumens; however, the resulting effect is that the junction temperatures run from a low 80° Celsius to a high 125° Celsius. This is at least one reason for the industry's poor thermal management, which leads to poor L70 data at 50,000 hours rather than a longer lifespan. Thus, if the temperature is over 40° Celsius over the lifetime of a driver, the driver lifetime goes from approximately 127K hours to 40K hours, which is not a positive result.

Figure 3A:
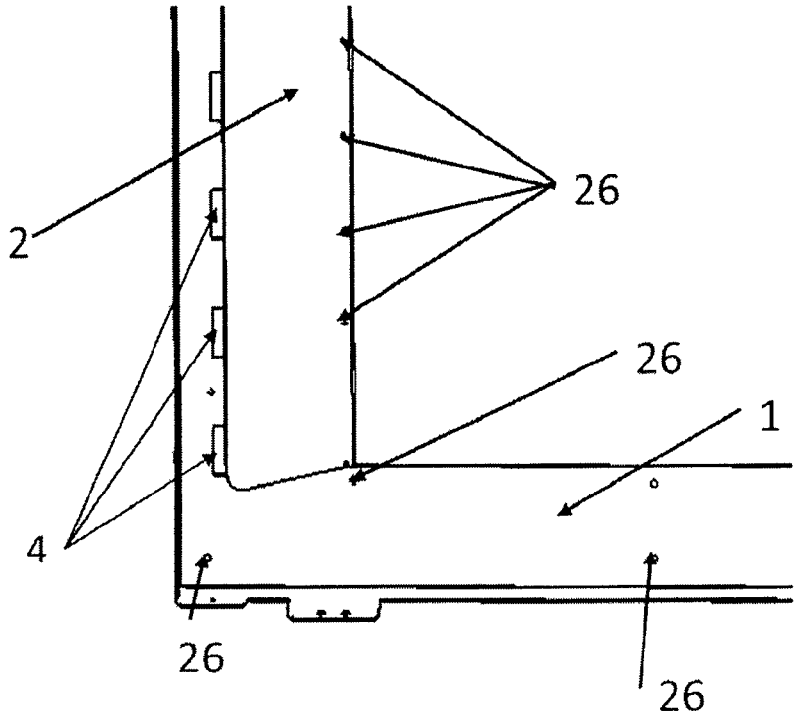
FIG. 3A is a perspective view of a corner of the housing of FIG. 1A in accordance with the disclosed subject matter.
Figure 3B:
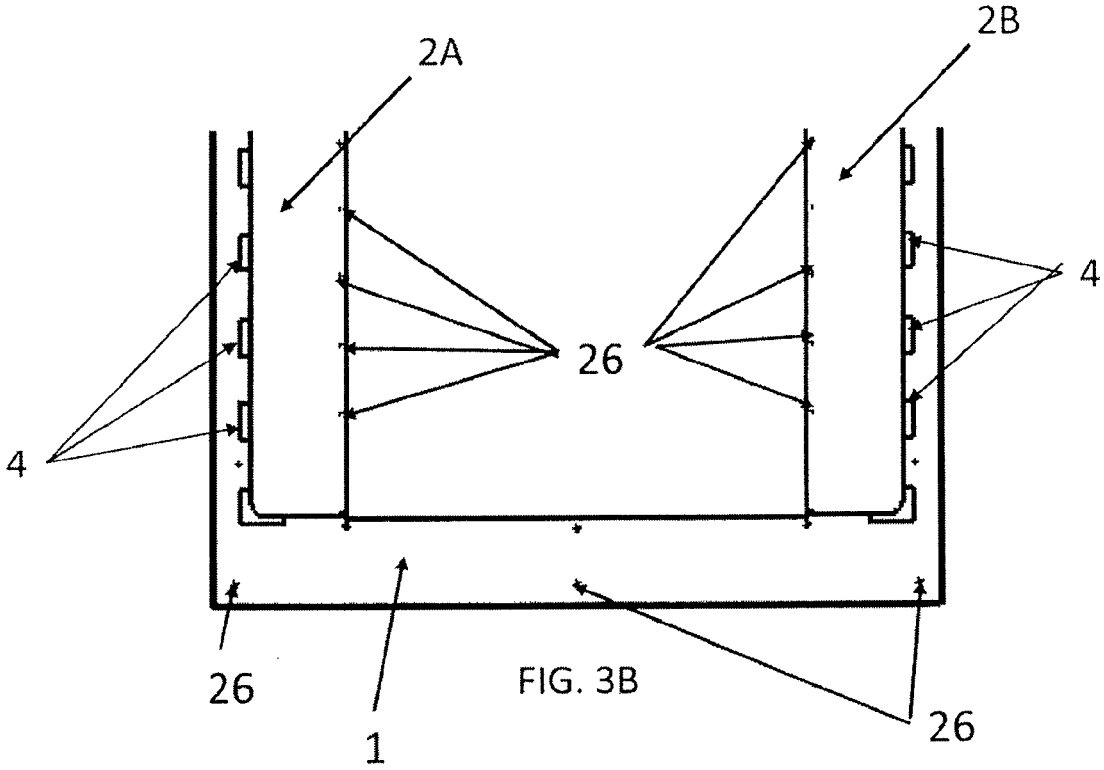
FIG. 3B illustrates a top view of the housing of FIG. 1A showing that the first side and second side frames partially cover the apertures located on the top surface of the housing in accordance with the disclosed subject matter.

Regarding FIGS. 1A, 3A and 3B, FIG. 3A shows a perspective view of a corner of the housing of FIG. 1A; in particular, showing holes 26 (viewed as circles) for fastening type devices on the housing top surface 1BB of the housing 1 and top surface 2AA of the frame 2. FIG. 3B illustrates a top view of the housing 1 showing that the first side and second side frames 2A, 2B partially cover the apertures 4 located on the top surface 1BB of the housing 1 of FIG. 1A. Further, FIG. 3B shows holes (viewed as +) 26 located on the top surface 2AA of the frame 2 and along the top surface 1BB of the housing 1 that can be utilized for fastening type devices. It is noted that the fastening type device can be made of an aluminum material so as to assist with heat sinking abilities to dissipate heat generated from the LED module 5.

Figure 4A:
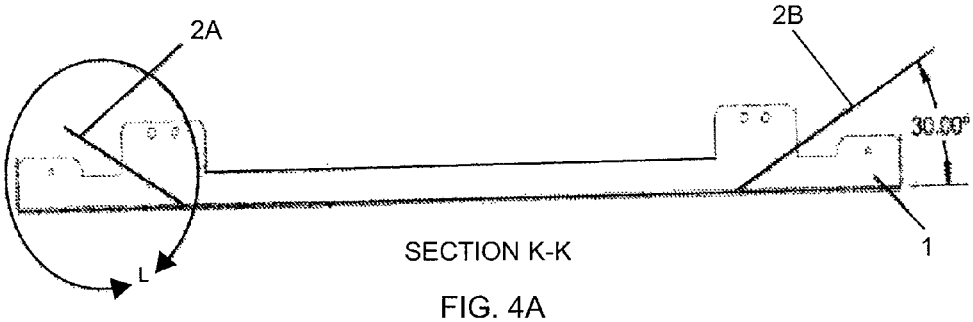
FIG. 4A illustrates an end view of the housing of FIG. 1A showing the two frames oriented at an angle in a range of 10° to 45°, or approximately 30°, extending from a plane perpendicular to a plane of the top surface of the housing, so as to form a V-shape type of orientation in accordance with the disclosed subject matter.
Figure 4B:
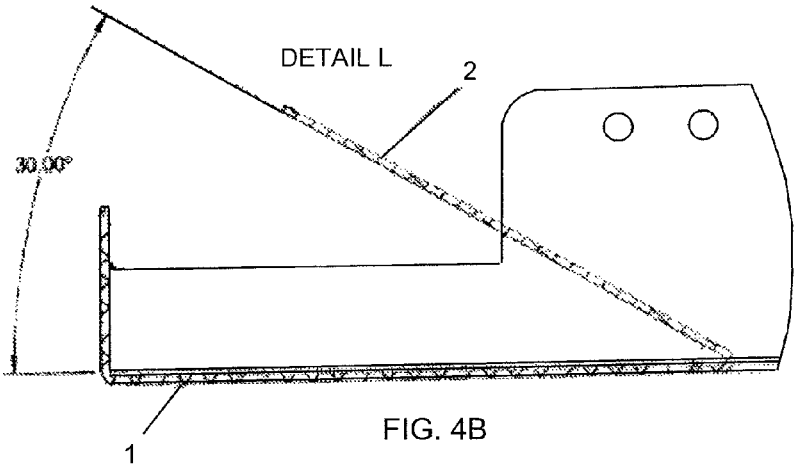
FIG. 4B is a close-up view of an end of the housing of FIG. 1A showing a frame oriented at an angle in a range of 10° to 45°, or approximately 30°, extending from a plane perpendicular to a plane of the top surface of the housing in accordance with the disclosed subject matter.
Figure 4C:
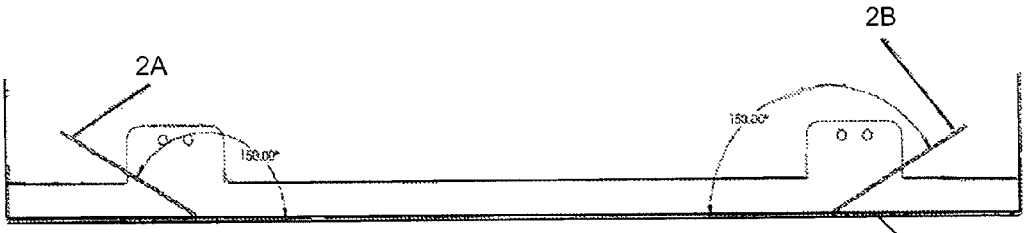
FIG. 4C illustrates an end view of the housing of FIG. 1A showing the two frames oriented at an angle of approximately 150° extending from a plane perpendicular to a plane of the top surface of the housing, so as to form a V-shape type of orientation in accordance with the disclosed subject matter.

Regarding FIG. 4A-FIG. 4C, FIG. 4A illustrates an end view of the housing of FIG. 1A that shows two frames 2A, 2B oriented at an angle in a range of 10° to 45°, or approximately 30°, extending from a plane Y (see FIG. 1A) perpendicular to a plane X (see FIG. 1A) of the top surface 1BB of the housing 1, so as to form a V-shape type orientation. FIG. 4B is a close-up view of the end of the housing 1 that shows frames 2A, 2B oriented at an angle in a range of 10° to 45° or approximately 30°. FIG. 4C illustrates the end view of the housing 1 showing two frames 2A, 2B oriented at an angle approximately 150° extending from a plane Y (see FIG. 1A) perpendicular to a plane X (see FIG. 1A) of the top surface 1BB of the housing 1, so as to form a V-shape type of orientation. Further, the 150° angle can be adjusted depending upon the function of the lighting fixture in view of the light and the size of the reflector, i.e., dome.

Figure 5A:
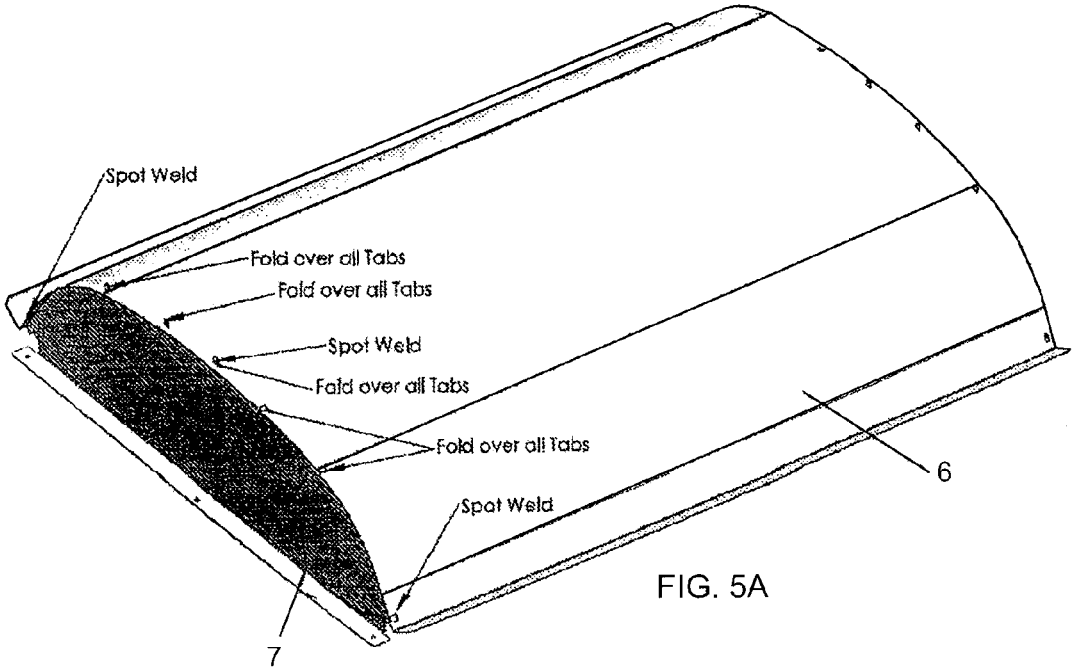
FIG. 5A is a perspective view of the reflector of FIG. 1A that further includes an end plate attached to the reflector in accordance with the disclosed subject matter.
Figure 5B:
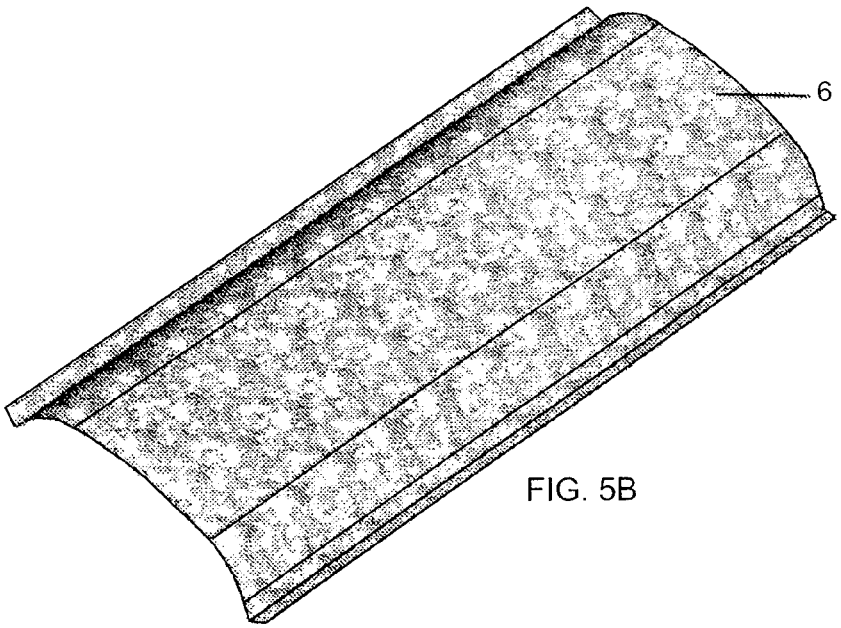
FIG. 5B is a perspective view of only the reflector of FIG. 1A in accordance with the disclosed subject matter.
Figure 5C:
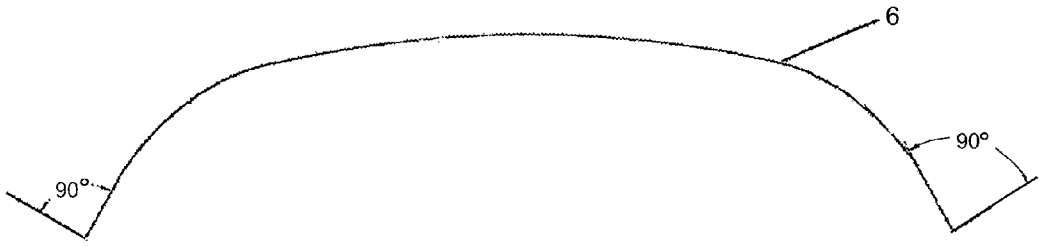
FIG. 5C is a cross-sectional view of the reflector of FIG. 1A showing a surface of the reflector including a dome shape or an arc shape, such that an end portion of a first side has a 90° angle and an end portion of a second side has a 90° angle in accordance with the disclosed subject matter.

Regarding FIG. 5A-5C, FIG. 5A shows a perspective view of the reflector 6 of FIG. 1A that further includes an end plate 7 attached to the reflector 6. At least one method for attaching the reflector 6 to the end plate 7 can include tab portions (labelled as tab portions) located on either the reflector 6 and/or end plate 7, such that the tab portions are bent for securing means. It is also contemplated that, in conjunction with tab portions, spot welds may be utilized to further assist in the securing means. It is possible that the tab portions and/or spot welding securing means could be used together or with some other type of fastening means, such as bolts, rivets and the like. FIG. 5B is a perspective view of only the reflector 6 of FIG. 1A; it can be noted that the underneath and top surface of the reflector 6 is uniform in shape. Further, one or more surfaces of the at least one reflector 6 can include one of a dome shape or an arc shape, such that at least one end portion has a 90° degree angle. FIG. 5B shows that it is also possible to have both end portions with a 90° degree angle. FIG. 5C is a cross-sectional view of the reflector 6 so as to clearly show the reflector 6 having a dome shape or an arc shape, such that the end portions have a 90° degree angle.

Referring to FIG. 5C, the reflector 6 includes a reflective enhancing material to reflect light, such as a white optics material. It is contemplated the reflector could include a textured surface wherein the reflective enhancing material is textured. In either case, the texture may be from the group consisting of one of a uniform imprinted texture, a non-uniform imprinted texture, an imprinted geometric shape or some combination thereof. It is likely that the reflective enhancing material is textured, either as the way it is being applied to the reflector or that the material itself provides a texture, and as a result, when applied, produces a texture. It is possible the textured reflective enhancing material includes one of a uniform height, a non-uniform height, or some combination thereof. Further, the at least one height of the textured reflective enhancing material may include a pattern, a non-uniform pattern or some combination thereof. It is noted that, when the textured reflective enhancing material is applied to a portion of the reflector, it may result in providing a uniform height, a non-uniform height or some combination thereof. Further, such texturing may cover at least 10% or more, 20% or more, 50% or more, or 75% or more of a surface of the reflector 6.

The pattern includes one or more ridges having at least one extended edge off of the ridge, two more extending edges off from the one or more ridges or some combination thereof. The at least one ridge may be oriented so as to direct reflected light in at least one particular direction, or two or more directions.

Figure 6:
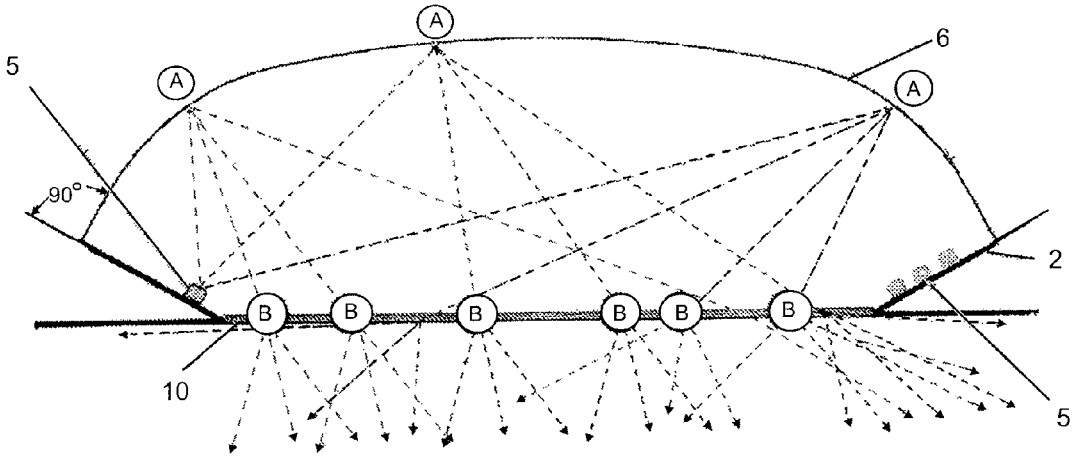
FIG. 6 is a cross-sectional view of the reflector of FIG. 1A showing at least one light refractivity in accordance with the present subject matter disclosed.

FIG. 6 is a cross-sectional view of the reflector of FIG. 1A, showing at least an aspect of light refractivity in accordance with the present disclosed subject matter. The reflector 6 can include white reflective optics which remove glare and allow for an almost perfect distribution (see FIG. 8). For example, the dome of the reflector (reflective portion or underneath portion) can be painted with the reflective white optics.

Still referring to FIG. 6, as noted above, reflective dome 6 is coated with a white optic adhesive or paint which allows the light to be reflective in multiple directions. The shape of the LED reflector dome is considered to be unique regarding the disclosed subject matter, among other things. The reflective white optics covering the dome, in combination with the other features of the lighting fixture, appear to provide for a unique design. The White Optics #98 is manufactured by White Optics, Inc. The lens material used to gain high performance and overall light quality is a 100% frost S80 AC080. At least one advantage in this type of lens material is the fracturing event when used in conjunction with the white optics. It is contrary to the lighting industry to use these materials because of the low light transmission of the 100% frost lens. However, by incorporating the features of the reflector dome and the overall reflector design in combination with the 100% frost lens, the presently disclosed subject matter successfully outperforms and lasts longer than presently known solid state light sources within the lighting industry. Certainly, competitors would not think to use a 100% frost lens in conjunction with the white optics because of the low light transmission of the 100% frost lens.

Still referring to FIG. 6, it is noted that the illumination from the diodes will be reflected off of the roof of the reflective dome. Due to the refractive properties of the reflective coating or reflective tape, the illumination can also be refracted in multiple directions. The disclosed subject matter regarding the lighting fixture 100 was designed to allow light refractivity to occur, among other things. For example, when the illumination from the LEDs leaves the frame 2 (or stamped heat sync) at the approximate 30° angle towards the reflective dome, the light will bounce off of the Reflective Coating of the interior side of the dome (see "A") and be refracted in multiple directions. The refracted light will travel to the lens 10, such that the refractive lens 10 will further refract the light downward (see "B") in multiple directions (the light will also refract upwardly, which is later discussed regarding FIG. 9 below).

Still referring to FIG. 6, the presently disclosed subject matter regarding the LED lighting fixture provides for a troffer having a lumen output range from one of 2,900 lumens to 6,000 lumens or more, 6,000 lumens to 9,000 lumens or more, 9,000 lumens to 12,000 lumens or more (2,900 to 32,000 lumens). Further, the presently disclosed subject matter provides for the LED lighting fixture to have a solder point temperature equal to or less than 33° Celsius, equal to or less than 40° Celsius, or equal to or less than 55° Celsius. Ideally, the solder point temperature would be approximately equal to or less than 33° Celsius. It is also noted that the lighting fixture can include a drive current of approximately 58.2 mA or less, approximately 80 mA or less, or approximately 100 mA or less. Ideally, the drive current would be approximately 58.2 mA or less.

Figure 7:
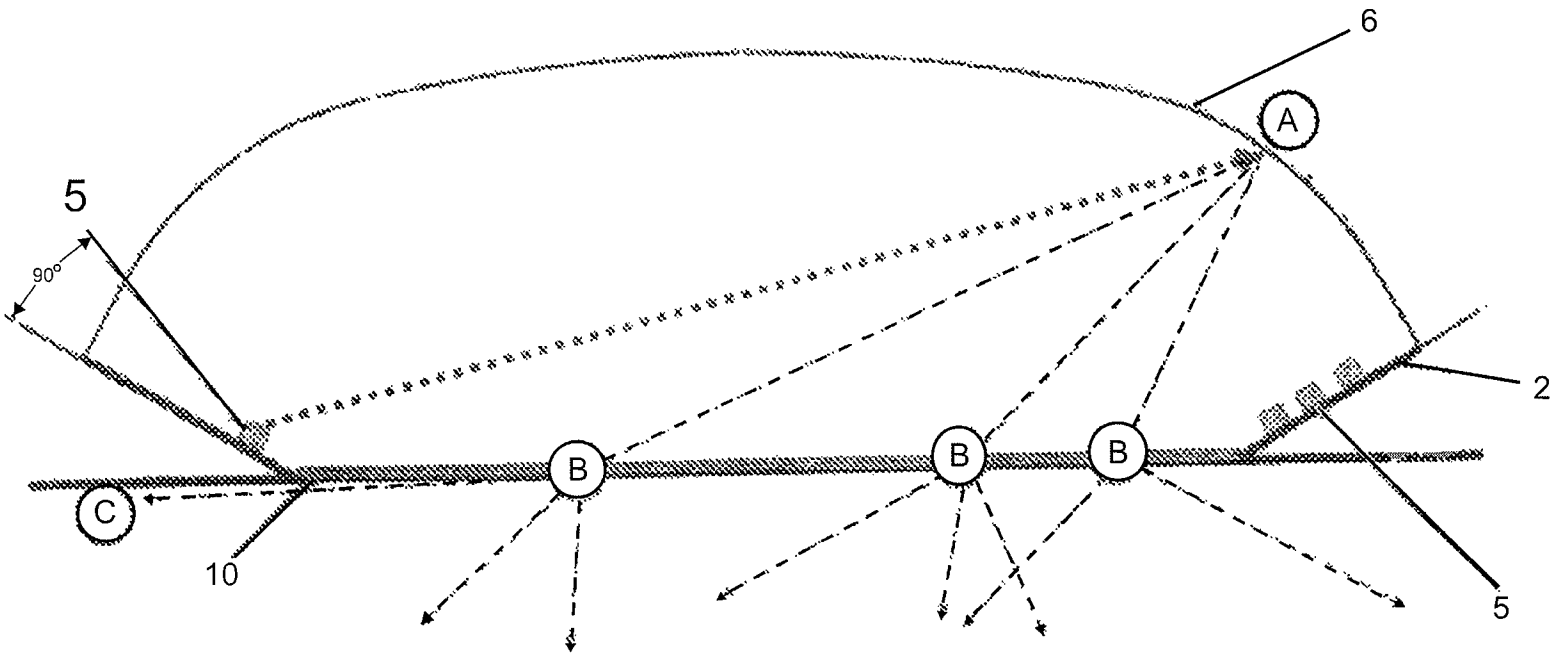
FIG. 7 is a cross-sectional view of the reflector of FIG. 1A showing the reflecting properties of the reflector that results in a horizontal refractivity so as to provide Horizontal Light in accordance with the present subject matter disclosed.

FIG. 7 is a cross-sectional view of the reflector of FIG. 1A, showing the reflecting properties of the reflector 6 that results in a horizontal refractivity. Horizontal light is due to the combination of the properties of the light reflecting off of the interior reflective dome 6 (see "A"), followed by the refraction through the lens (see "B"). The light then becomes further refracted and has been demonstrated to have nearly a horizontal refractivity (see "C"). Demonstration of this phenomenon can be seen in FIG. 7. When the refracted and reflected light makes contact with the lens, the light can be further refracted in multiple directions.

Figure 8:
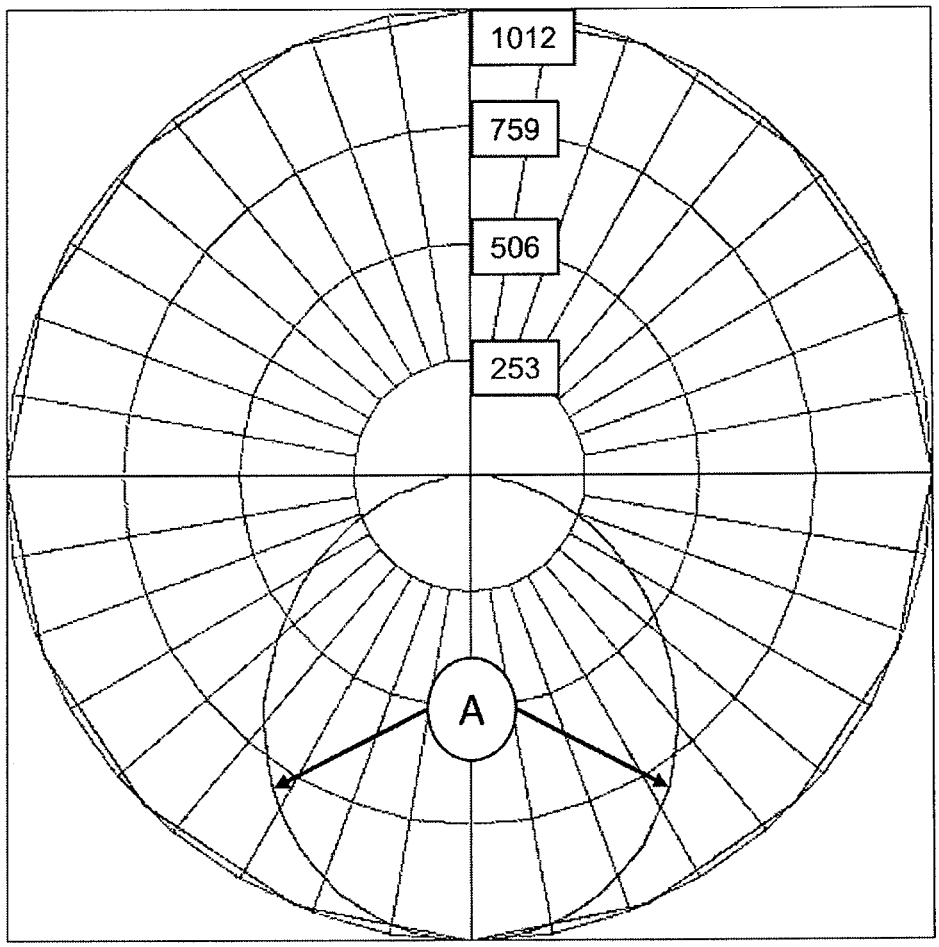
FIG. 8 is a report from the Illuminating Engineering Society (IES) conducted by Light Laboratory, Inc., demonstrating a nearly perfect light distribution throughout a room with the LED based light fixture of FIG. 1A in accordance with the present subject matter disclosed.

FIG. 8 is a report from the Illuminating Engineering Society (IES) conducted by Light Laboratory, Inc., demonstrating a nearly perfect light distribution throughout a room with the LED based light fixture of FIG. 1A. FIG. 8 is a 2-D (two-dimensional) representation of a 3-dimensional phenomenon. The circle represented by "A" demonstrates from the base or bottom of the light fixture (present disclosed subject matter) as represented by FIG. 7. Further, the circle represented by "A" in FIG. 8 is a representation of how the light can travel at a near horizontal level to the wall as seen in FIG. 7, Item C.

Figure 9:
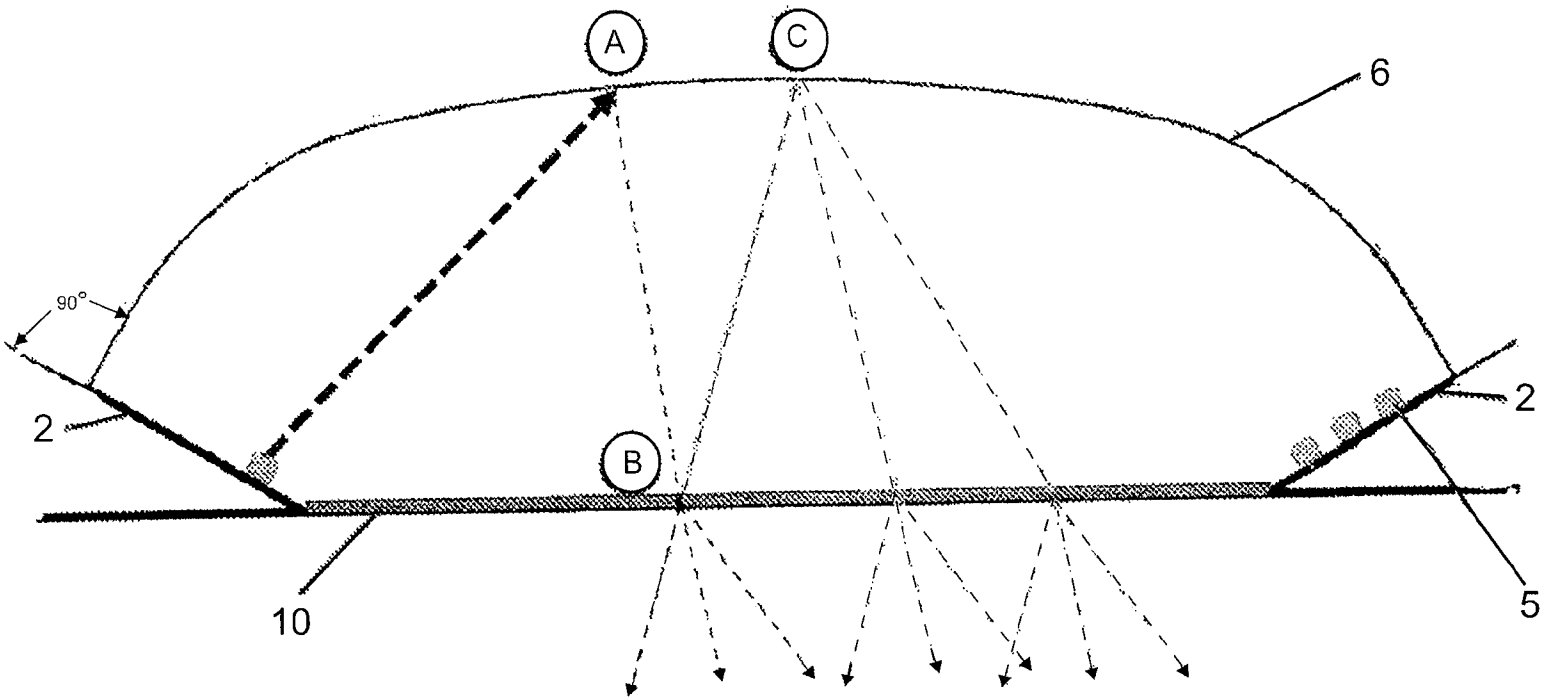
FIG. 9 is a cross-sectional view of the reflector of FIG. 1A showing the reflecting properties of the reflector, in particular, secondary bounce reflection wherein the LED light reflects off of the reflector and a secondary bounce occurs when refracted light from the reflector (or dome) hits the refractive lens and then is reflected back to the top of the reflector (dome) for a second bounce in accordance with the present subject matter disclosed.

FIG. 9 is a cross-sectional view of the reflector of FIG. 1A, showing the reflecting properties of the reflector 6, in particular, secondary bounce reflection wherein the LED light reflects off of the reflector 6 and a secondary bounce occurs when refracted light from the reflector (or dome) 6 hits the refractive lens 10, and then is reflected back to the top of the reflector (dome) 6 for a second bounce. Light from the LEDs reflects off of the reflective dome (see "A"), wherein a second bounce occurs when the reflected light of the dome 6 hits the refractive lens 10 and then is reflected back to the top of the dome for a "second bounce" (see "B"). For example, this allows for spacing of units and spacing criteria needed for use of one fixture, where other lighting systems would require two troffer systems for the same space. At least one result is that this allows for the elimination of up to one half of the current fixture systems, while providing as much or more light when replacing fixtures with the presently disclosed troffer, thus reducing additional energy consumption.

Figure 10A:
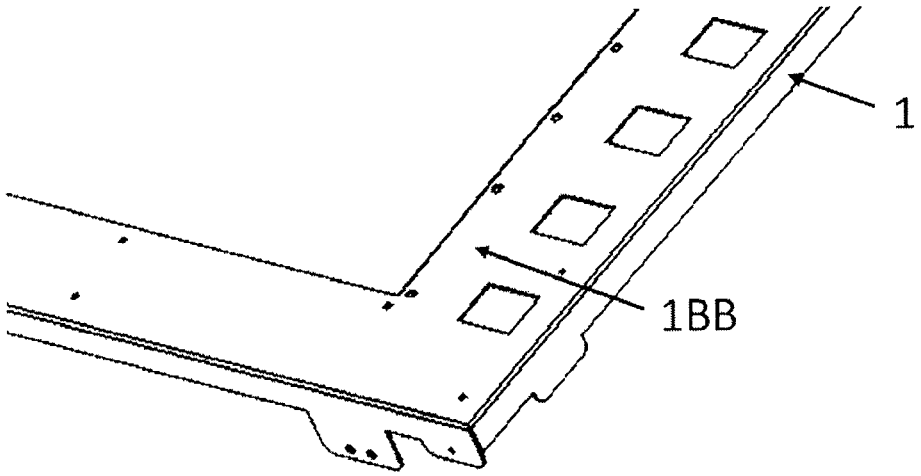
FIG. 10A illustrates a corner of the housing that discloses a method of reinforcing the corners by folding material extending from the top surface of the housing downward, so as to form a corner in accordance with the present subject matter disclosed.
Figure 10B:
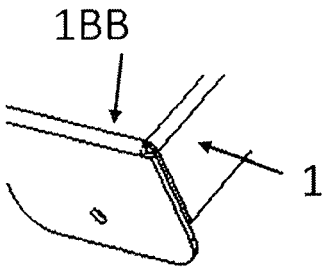
FIG. 10B illustrates a close-up of a corner of the housing disclosing the method shown in FIG. 10A; a method of reinforcing the corners of the housing by folding material extending from the top surface of the housing downward in accordance with the present subject matter disclosed.

Referring now to FIGS. 10A and 10B, FIG. 10A shows a corner of the housing that discloses a method of reinforcing the housing corners, which includes folding material extending from the top surface 1BB of the housing 1 downward, so as to form a corner. FIG. 10B shows a close-up of the corner of the housing 1 disclosing the method shown in FIG. 10A. The method of reinforcing the corners of the housing 1 by folding material extending from the top surface of the housing downward provides extra reinforcement strength to the housing 1.

Figure 11:
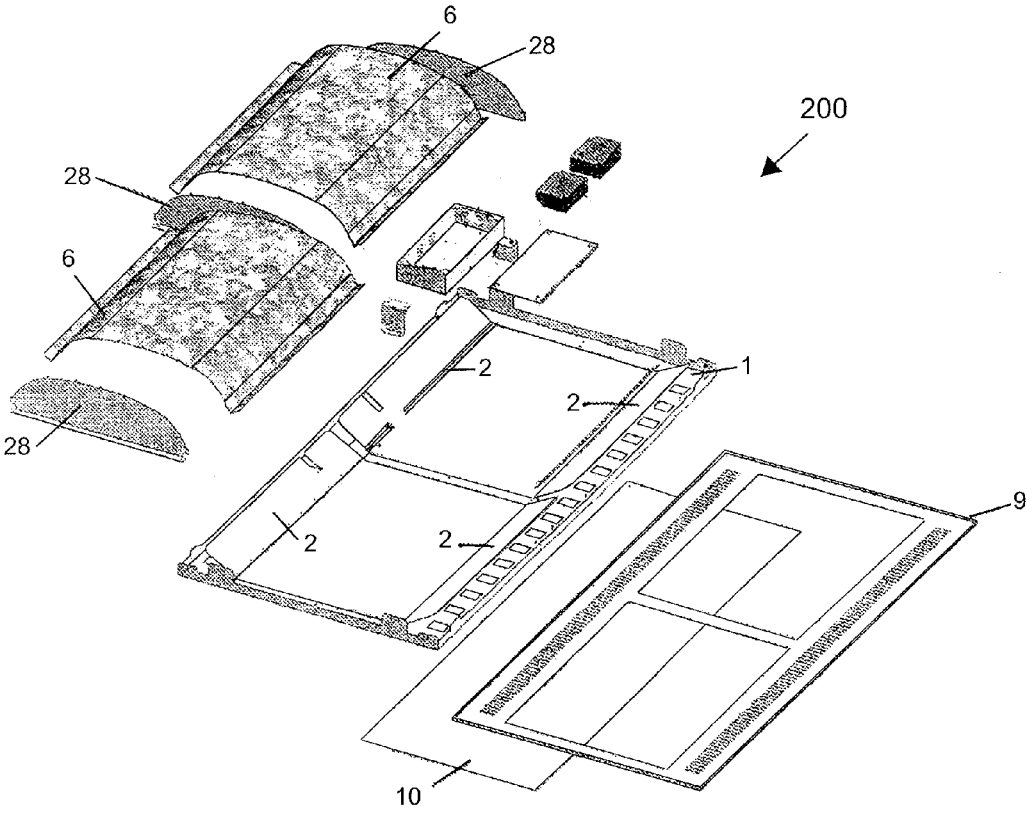
FIG. 11 is an exploded view of an LED based light fixture showing a single housing and lens frame with two frames and two domes in accordance with another exemplary embodiment of the disclosed subject matter.

FIG. 11 is an exploded view of an LED based light fixture 200, similar to FIG. 1A, showing a single housing 1 and lens frame 10; however, FIG. 11 has two sets of frames 2, two reflectors 6 and three end plates 28 connected to the reflectors 6, unlike FIG. 1A. FIG. 1A only has one frame set (two frames 2), one reflector 6, and two end plates 7.

Whereas many alterations and modifications of the present disclosure will no doubt become apparent to a person of ordinary skill in the art after having read the foregoing description, it is to be understood that the particular embodiments shown and described by way of illustration are in no way intended to be considered limiting. Further, the disclosure has been described with reference to particular preferred embodiments, but variations within the spirit and scope of the disclosure will occur to those skilled in the art. It is noted that the foregoing examples have been provided merely for the purpose of explanation and are in no way to be construed as limiting of the present disclosure. While the present disclosure has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present disclosure in its aspects. Although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims.

What is claimed is:

1. A light-emitting diode based lighting fixture, comprising:

said light fixture being a troffer that at least provides a horizontal light output distribution, said troffer substantially constructed from aluminum material and acts as a heat sink;

at least one reflector including a reflective enhancing material to reflect light and a pair of frames are attached on a top surface of at least one housing, said pair of frames attached to said at least one housing along an inner edge of each of said frames so that said pair of frames are spaced apart and angled upwardly with respect to a top surface of said at least one housing with an outer edge of each said frame spaced away from said housing so that a top surface of each of said pair of frames is angled toward the other of said pair of frames and said at least one reflector, a back surface of each said frame in contact only with air for cooling said pair of frames;

at least one light emitting diode strip mounted on said top surface of each said frame to emit light, said at least one light emitting diode strip including a plurality of strings of four light emitting diodes, each string of four light emitting diodes electrically connected to each other in series, each said light emitting diode is secured to said light emitting diode strip with a solder joint, said pair of frames each oriented at an angle in a range of 10° to 45° degrees with respect to the top surface of the at least one housing so that light emitted from said light emitting diodes is directed into said reflector to be reflected out of said light fixture;

a driver for supplying power to said at least one light emitting diode strip, said driver electrically connected to said at least one light emitting diode strip, said driver supplying 24 volts to each said at least one light emitting diode strip, said driver supplying a maximum of 58 milliamps to each said light emitting diode so that each said solder joint achieves a maximum temperature of 33 degrees Celsius during operation of said string of light emitting diodes; and at least one lens positioned approximate to a bottom surface of the at least one housing for reflective light to emit there through.

2. The light emitting diode based lighting fixture of claim 1, wherein at least one LED module of the one or more LED module is dimmable and includes at least one white light emitting diode light.

3. The light emitting diode based lighting fixture of claim 1, wherein the at least one reflector includes two or more end plates.

4. The light emitting diode based lighting fixture of claim 1, wherein the reflective enhancing material is one of a white optics material or a material having properties similar to reflective properties of the white optics material.

5. The light emitting diode based lighting fixture of claim 1, wherein the lighting fixture includes at least one junction box, such that the junction box is vented via natural convection by one or more vents.

6. The light emitting diode based lighting fixture of claim 1, wherein the lighting fixture provides for a lumen output range from one of 2,900 lumens to 6,000 lumens or more, 6,000 lumens to 12,000 lumens or more, or 12,000 lumens to 32,000 lumens or more.

7. The light emitting diode based lighting fixture of claim 1, wherein the at least one housing includes at least one lens frame having at least one aperture that is attached to the bottom surface of the housing so as to secure the at least one lens, the at least one housing includes two or more apertures and the at least one lens frame includes two or more apertures, such that the two or more apertures of the at least one housing and the at least one lens frame are approximately aligned, so together dissipate heat generated by the one or more light emitting diode modules.

8. A light-emitting diode ("LED") based lighting fixture, comprising:

said lighting fixture is a troffer that at least provides a horizontal light output distribution, at least one reflector including a reflective enhancing material such as a white optics material to reflect light and two or more aluminum frames, the at least one reflector and two or more aluminum frames are attached on a top surface of at least one housing, said two or more frames attached to said at least one housing along an inner edge of each of said frames so that pairs of frames are spaced apart and angled upwardly with respect to a top surface of said at least one housing with an outer edge of each said frame spaced away from said housing so that a top surface of each of said pair of frames is angled toward the other of said pair of frames and said at least one reflector, a back surface of each said frame in contact only with air for cooling said pair of frames;

a plurality of strings of four light emitting diodes, each string of four light emitting diodes electrically connected in series, each said light emitting diode in each string being secured to an aluminum circuit board with a solder joint, mounted on said top surface of each said frame to emit light, the two or more frames oriented at an angle in a range of 10° to 45° degrees with respect to a plane forming the top surface of the at least one housing, so as to form a V-shape type of orientation directing light from said diodes toward said at least one reflector;

a driver for supplying twenty four volts of electrical power to each said string of light emitting diodes, said driver electrically connected to said plurality of strings of light emitting diodes, said driver supplying electrical power to each said light emitting diode string so that each said solder joint reaches a maximum temperature of 33 degrees Celsius during operation thereof, and at least one lens positioned approximate to a bottom surface of the at least one housing for reflective light to emit there through so as to provide a uniform lighting effect.

9. The light emitting diode based lighting fixture of claim 8, wherein the lighting fixture is a troffer substantially made of an aluminum material and acts as a heat sink to dissipate heat generated by said plurality of strings of light emitting diodes.

10. The light emitting diode based lighting fixture of claim 8, wherein said driver provides 6 volts to each said light emitting diode in each said string of light emitting diodes, said driver supplying a maximum of 58 milliamps to each said light emitting diode, whereby said maximum solder joint temperature is maintained.

11. The light emitting diode based lighting fixture of claim 8, wherein the at least one housing includes two or more apertures and at least one lens frame including two or more apertures, such that the two or more apertures of the at least one housing and the at least one lens frame are approximately aligned, so together dissipate heat generated by said plurality of strings of light emitting diodes.

12. The light emitting diode based lighting fixture of claim 11, wherein the two or more apertures of one of the at least one housing, the at least one lens frame, or both occupy at least 10% of a total surface area of the top surface area of the housing.

13. The light emitting diode based lighting fixture of claim 8, wherein the lighting fixture includes a universal mounting device, and the universal mounting device includes two or more brackets attached to the housing, so that an attaching wire is provided for securing the lighting fixture for operation.

14. The light emitting diode based lighting fixture of claim 8, wherein the lighting fixture includes at least one junction box, such that the junction box is vented via natural convection by one or more vents.

15. The light emitting diode based lighting fixture of claim 8, wherein one or more surface of the at least one reflector includes one of a dome shape or an arc shape, such that an end portion of a first side has a 90 degree angle and an end portion of a second side has a 90 degree angle.

16. The light emitting diode based lighting fixture of claim 8, wherein the lighting fixture includes a drive current of one of approximately 58.2 milliamps or less.

17. The light emitting diode based lighting fixture of claim 8, wherein the at least one reflector is integral with two or more frames and fastened to the at least one housing.

18. The light emitting diode based lighting fixture of claim 8, wherein the two or more frames are approximately equal to or greater than 5% or more of a total surface area of the top surface of the at least one housing.

19. The light emitting diode based lighting fixture of claim 8, wherein the two or more frames extend more than 50% or more along a side of the at least one housing.

20. The light emitting diode based lighting fixture of claim 8, wherein the reflective enhancing material is textured, such that the texture is from the group consisting of one of a uniform imprinted texture, a non-uniform imprinted texture, an imprinted geometric shape or some combination thereof.

21. The light emitting diode based lighting fixture of claim 8, wherein the plurality of strings of four light emitting diodes are positioned so that at least 80% of the light is incident on the reflective enhancing material of the at least one reflector.

22. The light emitting diode based lighting fixture of claim 8, wherein the at least one reflector includes an imprinted textured surface, so as to reflect light, wherein the textured surface comprises a material that is at least semi specular before the reflector is textured.

23. A light-emitting diode ("LED") based lighting system, comprising:

said light emitting diode based lighting system being a troffer that at least provides a horizontal light output distribution;

at least one reflector including a reflective enhancing material such as a white optics material to reflect light and two or more frames, the at least one reflector and the two or more frames are attached on a top surface of at least one housing;

two or more light emitting diode modules mounted on a top surface of the two or more frames to emit light, each said light emitting diode module including a plurality of strings of four light emitting diodes, each string of four light emitting diodes electrically connected in series, each said light emitting diode being secured to said module with a solder joint, the two or more frames oriented at an angle in a range of 10° to 45° degrees with respect to a plane a plane formed by the top surface of the at least one housing, said frames attached to said at least one housing along an inner edge of each of said frames so that said frames are spaced apart and angled upwardly with respect to a top surface of said at least one housing with an outer edge of each said frame spaced away from said housing so that a top surface of each of said pair of frames is angled toward the other of said pair of frames and said at least one reflector so as to form a V-shape type of orientation, a bottom surface of each said frame in contact only with air for cooling said pair of frames;

a driver for supplying power to said two or more light emitting diode modules, said driver electrically connected to said two or more light emitting diode modules, said driver supplying 6 volts at a maximum of 58 milliamps of electrical power to each said light emitting diode secured on each said module so that each said solder joint reaches a maximum temperature of 33 degrees Celsius during operation thereof, and at least one lens positioned approximate to a bottom surface of the at least one housing for reflective light to emit there through, so as to provide a uniform lighting effect.

24. The light emitting diode based lighting system of claim 18, wherein the lighting fixture is a troffer substantially made of an aluminum material and acts as a heat sink to dissipate heat generated by the two or more light emitting diode modules.

25. The light emitting diode based lighting system of claim 23, wherein the lighting fixture provides a horizontal light output distribution, such that at least one light emitting diode module of the two or more light emitting diode modules is dimmable and includes at least one white light emitting diode light.

26. The light emitting diode based lighting system of claim 18, wherein the lighting fixture provides for a lumen output range of at least 2,900 lumens.

27. The light emitting diode based lighting system of claim 18, wherein the lighting fixture includes at least one junction box, such that the junction box is vented via natural convection by one or more vents.

* * * * *